US006835014B2

(12) United States Patent
Hinojosa et al.

(10) Patent No.: US 6,835,014 B2
(45) Date of Patent: Dec. 28, 2004

(54) COMPONENT ATTACHMENTS

(75) Inventors: Antonio Hinojosa, Barcelona (ES); Lluis Valles, Barcelona (ES); Carles Viñas, Barcelona (ES)

(73) Assignee: Hewlett-Packard Development Company, LP., Houston, TX (US)

( * ) Notice: Subject to any disclaimer, the term of this patent is extended or adjusted under 35 U.S.C. 154(b) by 24 days.

(21) Appl. No.: 09/935,854

(22) Filed: Aug. 23, 2001

(65) Prior Publication Data

US 2002/0061220 A1 May 23, 2002

(51) Int. Cl.[7] ..... B41J 29/02
(52) U.S. Cl. ..... 400/691; 400/656
(58) Field of Search ..... 400/619, 693, 400/694, 656, 648

(56) References Cited

U.S. PATENT DOCUMENTS 4,215,946 A * 8/1980 Nakabo et al. ..... 400/689
4,549,354 A 10/1985 Affa et al. ..... 33/125 T
4,957,382 A * 9/1990 Delaney et al. ..... 400/656
5,228,238 A 7/1993 Fenkell ..... 49/63
5,285,354 A 2/1994 Ohsawa et al. ..... 361/752
5,797,691 A 8/1998 Suzuki ..... 400/320
5,816,724 A * 10/1998 Hada et al. ..... 400/656
6,036,380 A * 3/2000 Astroth et al. ..... 400/23
6,196,672 B1 * 3/2001 Ito et al. ..... 347/88

FOREIGN PATENT DOCUMENTS

| | | |
|---|---|---|
| EP | 03213295 | 9/1991 |
| EP | 08006385 | 1/1996 |
| EP | 09076542 | 3/1997 |
| FR | 2768196 | 3/1999 |
| FR | 2768197 | 3/1999 |

* cited by examiner

*Primary Examiner*—Anthony H. Nguyen

(57) ABSTRACT

A printer vacuum guide member of plastics material, attached to a printer chassis of metal so as to allow thermal movements, has flexible limbs which extend from walls near the ends of the member to attachment points for receiving fixing screws. The member is fixedly attached to the chassis at points at a central location. To further reduce the effects of thermal expansion, the guide member may be sub-divided into separate component parts along its length.

11 Claims, 7 Drawing Sheets

COMPONENT ATTACHMENTS

BACKGROUND OF THE INVENTION

1. Field of the Invention

The present invention relates to attaching components to each other and in particular connecting together components of a machine, such as a printer, which are made of materials having different coefficients of thermal expansion.

2. A Discussion of the Background Art

When components made of such materials are attached to each other over a substantial extent, the effect of unequal expansion produces tensions and deformations of the components. This effect is exploited in a bimetallic strip to form a simple thermal switch. In machines, such as printers, it is often desirable to use different materials for components which are to be attached to each other, for example a metal for a printer chassis and a plastics material for a vacuum guide. However, this can involve the above-mentioned problems producing distortion, which is extremely disadvantageous for components, such as a printing platen, which define part of the paper path and for which a high degree of planarity is required at all operating temperatures. Furthermore, any changes in the degree of planarity during operation will alter the separation of the printhead and the print medium—the so-called pen-to-paper distance. This is difficult to monitor and to take appropriate steps to compensate thus leading to dot displacement and consequently a reduction in print quality.

SUMMARY OF THE INVENTION

The present invention seeks to overcome or reduce one or more of the above problems.

According to a first aspect of the present invention, there is provided a device comprising at least two components adjoining each other over a length and having different thermal coefficients of expansion, the components being attached to each other by first attachment means at a first position and by second attachment means at a second position, spaced from said first position along said length, the first and second components being relatively fixed at the first position, characterised in that at least a first of the components is formed so that, at the second position, it can move relative to the other component.

The first component is preferably formed at the second position with a limb which connects the second attachment means to the remainder of the first component, the limb being capable of flexing in the direction of said length.

An advantage of such an arrangement is that, apart from flexure of the limb, no other deformation of the components occurs.

The first component may be sub-divided into separate sub-components which are respectively attached to the other component at spacings in the direction of said length. This may constitute an independent aspect of the present invention.

In a preferred embodiment one or both of said components are capable of bowing in a direction perpendicular to the adjoining surfaces of said components and the total amount of bow is equal to or less than 0.02% of said adjoining length.

The total amount of bow is equal to or less than 0.02% over the normal range of operating temperatures of said device.

Thus according to a second aspect of the present invention, there is provided a device comprising at least two components adjoining each other over a length and having different thermal coefficients of expansion characterised in that a first of the components is sub-divided into a plurality of sub-components respectively attached to the other component at spacings in the direction of said length.

According to the third aspect of the present invention there is provided a device comprising first and second components adjoining each other over a length and having different thermal coefficients of expansion, the components being attached to each other at a first position and at a second position, spaced from said first position along said length, characterised in that said first and second attachment positions are relatively displaceable in the direction of said length.

The first component is preferably a vacuum guide for a printer and made of plastics material and the second component is preferably a printer chassis made of another material such as sheet metal.

BRIEF DESCRIPTION OF THE DRAWINGS

Preferred embodiments of the invention will now be described, by way of example only, with reference to the accompanying drawings, of which.

DETAILED DESCRIPTION OF THE INVENTION

Figure 1:
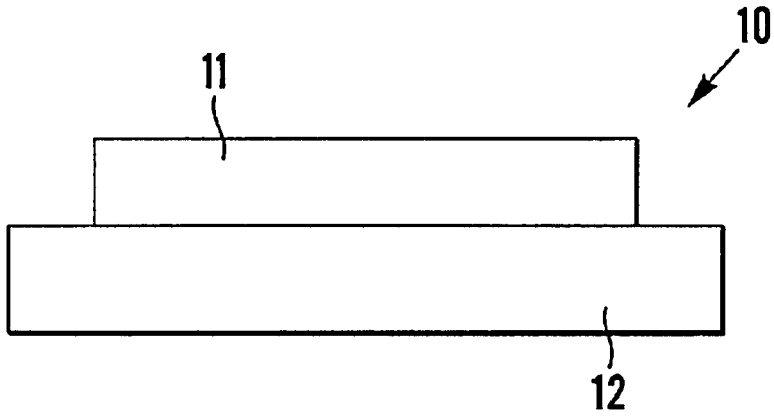
FIG. 1 is a side view, at a first temperature, of two adjoining materials having different thermal coefficients of expansion.

Referring now to the drawings, FIG. 1 shows an arrangement 10 comprising a first component 11 of a first material attached to a second component 12 of a second material at a temperature Ta. For example, component 11 may be of plastics material and component 12 may be of sheet metal material. Component 11 has a thermal coefficient of expansion Cp which is higher than the thermal coefficient of expansion Cs of component 12.

Figure 2:
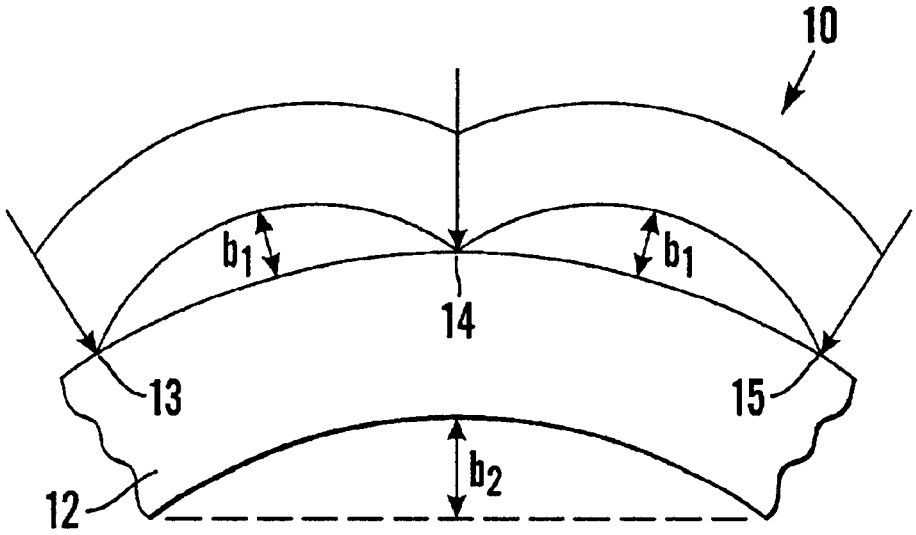
FIG. 2 is a side view of the materials of FIG. 1 at a higher temperature.

FIG. 2 shows, in exaggerated form, the shape of the components 11, 12 at a temperature Tc higher than temperature Ta. Points 13, 14 and 15 represent positions at which the two components are fixedly attached to each other. It will be noted that both components are deformed because component 11 expands more than component 12 to produce respective bow distances b1 and b2.

For the planar components discussed below, there is a maximum permitted deviation of 0.2 mm in the z-direction, i.e. the direction perpendicular to the plane of the component. For a printer platen having a length of 1 meter, this corresponds to a combination of materials leading to a total bowing or deviation factor of 0.02% (corresponding to bi+b2) over the normal range of operating temperatures, and a central point of attachment 14 would not be required. For a platen of the same materials and having a greater length, then one or more intermediate points of attachment 14 are required to ensure that nowhere does the deviation exceed 0.2 mm.

A number of measures have been proposed with a view to reducing the problems, in particular the loss of planarity and the relative movement, caused by the deformation. For example, first and second materials have been selected with relatively close thermal coefficients of expansion. This imposes severe design restrictions on the production of devices, such as printers, and would exclude, for example, the use of adjoining plastics and metal components. Another proposal is to employ only a single position of attachment (e.g. position 14) but this leads to insufficient robustness in the attachment and there is a higher likelihood of the device failing a drop test.

Figure 3:
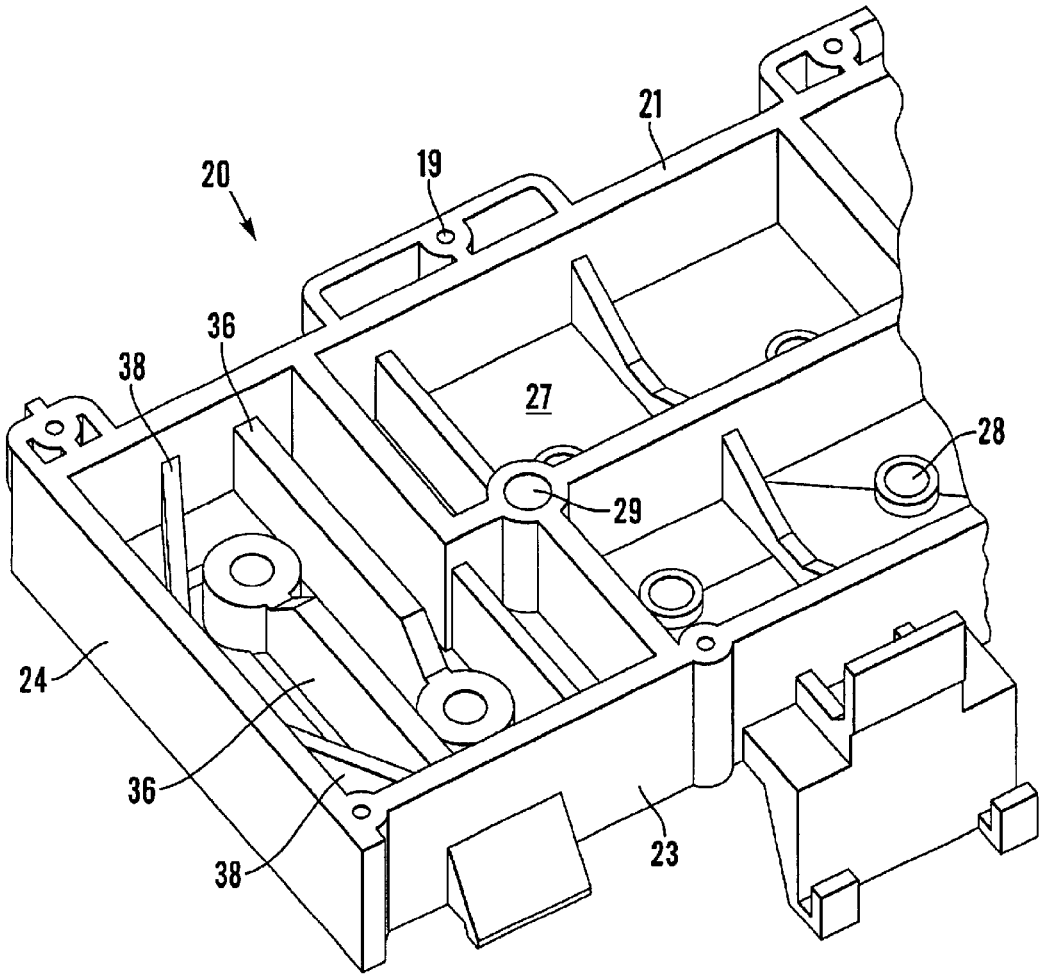
FIGS. 3 and 4 are perspective and top views respectively of one end of a printer vacuum guide component in accordance with the invention.
Figure 4:
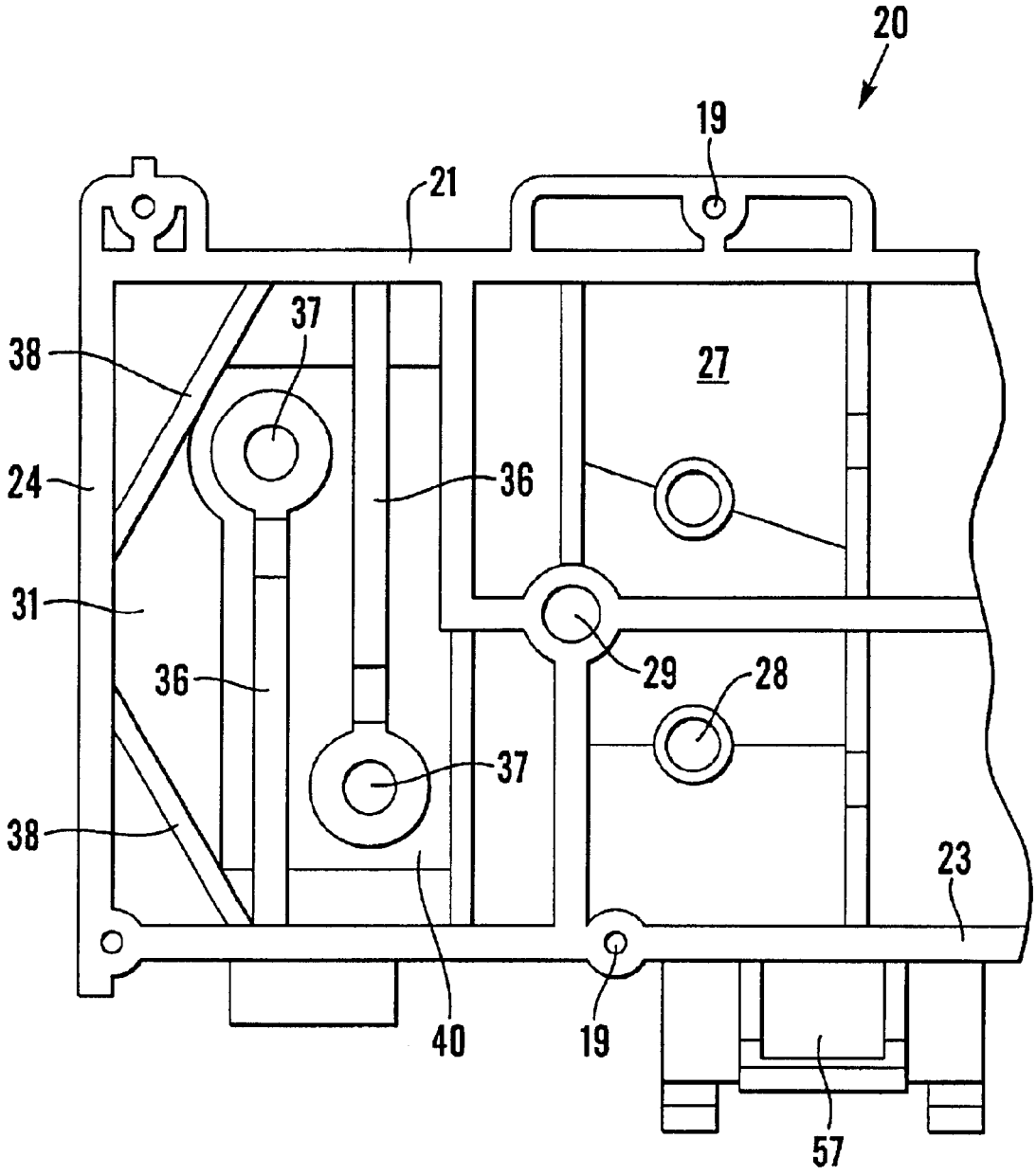
Figure 5:
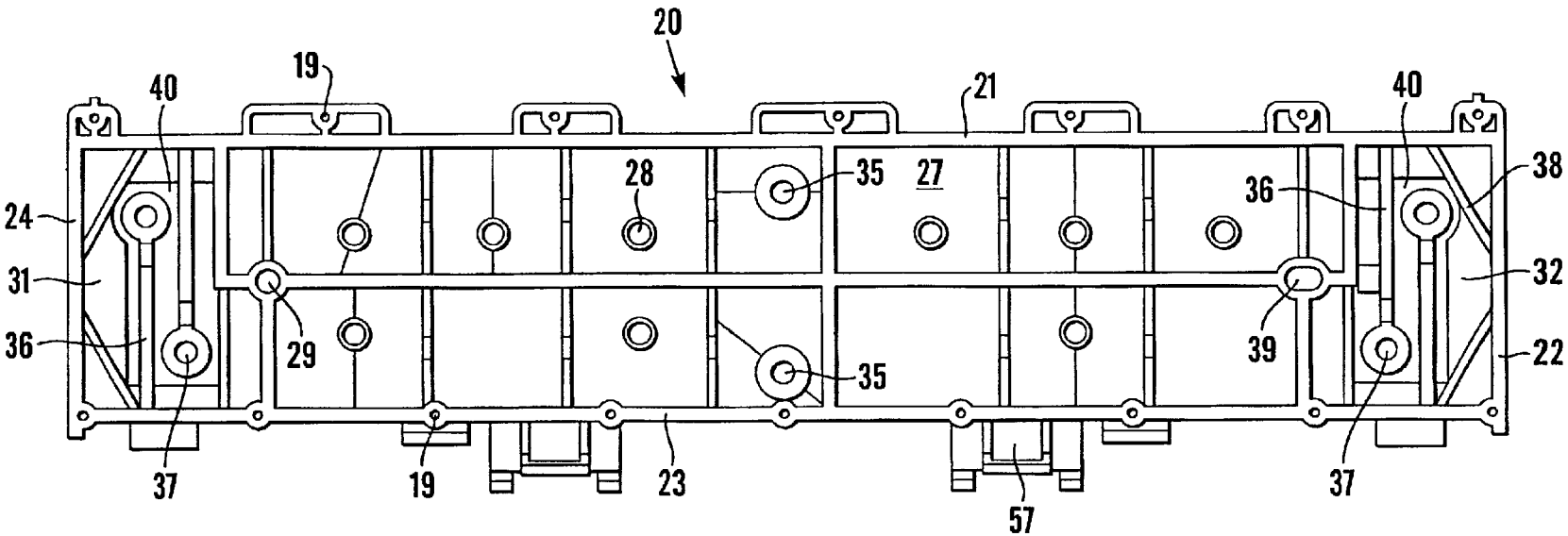
FIG. 5 is a top view of the entire component of FIGS. 3 and 4 and on a smaller scale.

FIGS. 3 to 5 show the vacuum guide member 20 of a printer, the guide being used to exert suction on the paper or other print medium to cause it to lie flat against the platen (not shown). The member 20 is of plastics material and comprises four side walls 21–25 defining a rectangle, and a lower wall 27 through which pass a plurality of vacuum tubes 28. Lower wall 27 covers the central portion of the lower major surface of the member 20, but end regions 31, 32 are left open. Integral external fittings 57 are for the attachment of a non-structural cover plate (not shown).

At the centre of member 20 it is held fixedly against the underlying sheet metal chassis 40 of the printer by means of fixing screws which pass through openings 35 in the member 20 into corresponding screw holes (not shown) in the chassis. In the end regions 31, 32 the member is provided with flexible limbs 36 which project internally from opposing walls 21, 23. The ends of the limbs remote from the wall are provided with integral tubular elements defining openings 37 for receiving screws for attachment to corresponding screw holes in the underlying chassis 40. The member 20 also incorporates internal bracing members 38 across its corners. A platen (not shown) of flat plastics material is secured to the top of member 20 to form part of the paper path of the printer. The platen is referenced to the member 20 by a circular hole 29 and an elongated hole 39, and is attached thereto by screws passing into peripheral screw holes 19.

FIGS. 3 to 5 show the vacuum guide member at normal room temperature. As the printer heats up, either during use or in a hot environment, the plastics member 20 expands more than the sheet metal chassis. The attachments through the openings 35 at the centre remain relatively stationary, but the end portions of the member 20 move slightly away from the centre so that limbs 36 flex slightly towards the centre.

Figure 6:
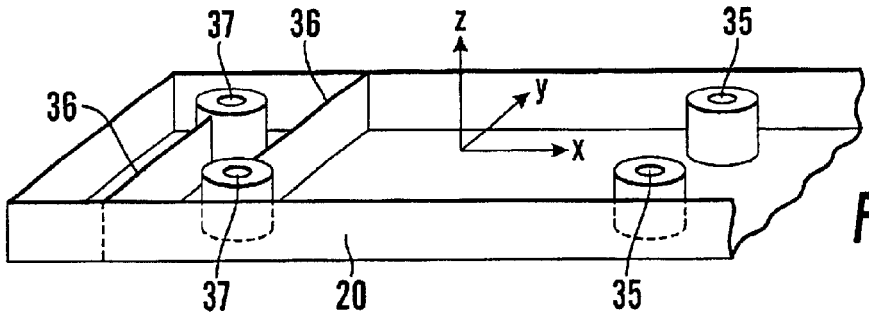
FIGS. 6 and 7 are perspective and top schematic views respectively of a plastics component at a first temperature.
Figure 7:
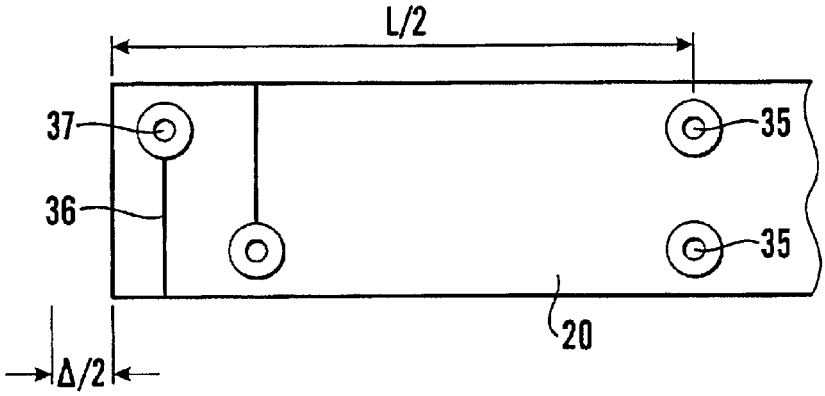
Figure 8:
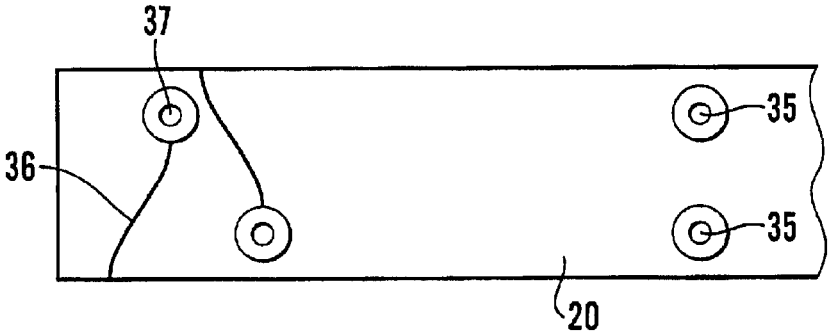
FIG. 8 is a top view of the component of FIGS. 6 and 7 at a higher temperature.

This process is illustrated in exaggerated fashion in FIGS. 6 to 8 which show schematic views of the plastics member 20. FIGS. 6 and 7 show the member at a normal ambient temperature Ta. FIG. 6 defines the x, y and z co-ordinates of the system, so that limbs 36 deflect in the x-direction. FIG. 7 defines the half length L/2 of the member 20 and the relative displacement Δ/2 of each end of the member 20 relative to the chassis 40.

The total relative displacement A can be calculated as:

$$\Delta=(Cp-Cs)\times(Tc-Ta)\times L$$

wherein Δ and L are as defined by FIG. 7 and wherein the remaining symbols are the same as defined in connection with FIG. 1.

In the expanded configuration, the horizontal forces acting against the expansion are the friction arising between the contacting surfaces of member 20 and chassis 40, and the force necessary to bend the flexible limbs 36. The frictional force is equal to the product of the coefficient of friction and the force Fz exerted by the screws in openings 37. The force needed to flex the limb 36 can be expressed as:

$$Fx = \frac{k \cdot E \cdot Ix}{q^3} \times \frac{\Delta}{2}$$

where k is a constant, e is Young's modulus for the plastics material,

Ix is the moment of inertia of the section, and q is the length of the limb.

Figure 9:
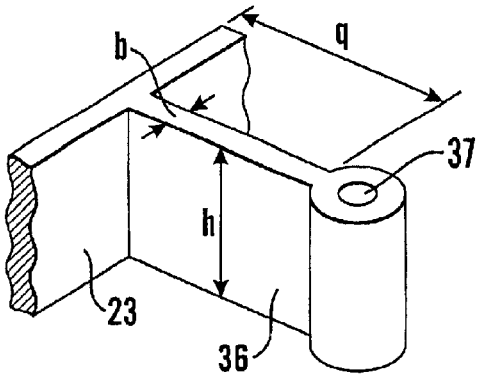
FIG. 9 is an enlarged view of a flexible attachment part of the component of FIGS. 6 to 8.

For the particular case of FIG. 9

$$Ix = \frac{h \cdot b^3}{12}$$

where h is the height of the limb, and b is the thickness of the limb.

The above described arrangement has numerous advantages. In particular the materials for components 20 and 40 may be selected independently without restrictions. In addition, the contact force Fz between the two compounds may be high, so that they cannot make unwanted relative movements. A particular advantage in supporting printer platens is that the plastics component directly beneath the platen maintains its flatness so that the printing quality does not deteriorate in any way as the temperature varies. It will be noted that all the flexibility to cater for thermal movements is provided by a single component 20 which means that it can be manufactured and assembled relatively easily and cheaply and that the other printer parts used can be completely conventional. No additional parts, such as springs, are required.

Various modifications may be made to the above-described arrangement. As mentioned previously, any two materials may be used for components 20 and 40. For example, the chassis 40 can be of aluminum or of a different plastics material from component 20. In addition the components may be any parts of a printer or other device and may be sheet elements, or hollow or solid members.

Only a single limb 36 may be provided at each end, or three or more limbs could be provided to give extra strength. The limbs 36 may be more evenly spaced along the length of the arrangement. A single fixed attachment, or more than two fixed attachments, may be provided at the centre.

Other means for providing relative motion may be employed. For example, the fixing screws may pass through longitudinal slots in one of the components to permit expansion and contraction movements.

Figure 10:
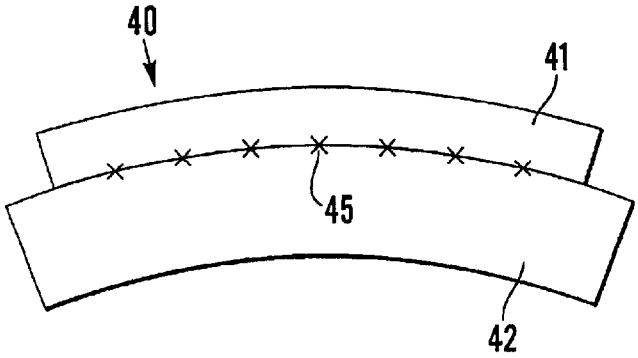
FIG. 10 is a side view of two adjoining materials having different thermal coefficients of expansion.

An alternative or additional modification will now be described with reference to FIGS. 10 to 14. FIG. 10 is a schematic side view, at a raised temperature Tc of a member 40 comprising two components 41, 42 having different thermal coefficients of expansion, e.g. plastics material and metal respectively. As indicated at 45, the two components are fixedly attached to each other at a relatively high number of closely-spaced attachment points.

Figure 11:
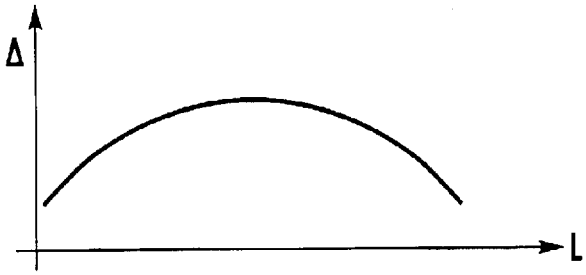
FIG. 11 is a graph indicating the deflection in the z-direction along the length of the materials of FIG. 10 at two different temperatures.

FIG. 11 is a graph showing the deflection Δ of the member 40 in a direction perpendicular to its plane when it is raised from a normal ambient temperature Ta to a higher temperature Tc. It is assumed that the member 40 will be flat at temperature Ta and that its ends are relatively fixed, so that the deflection increases from the ends towards the middle.

Again, this problem can be reduced by using materials with similar thermal coefficients of expansion, but this imposes severe design restraints.

Figure 12:
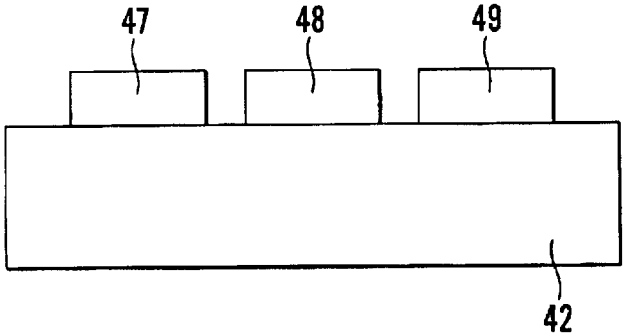
FIG. 12 is a schematic side view of an arrangement in accordance with the present invention comprising materials having different thermal coefficients of expansion.
Figure 13:
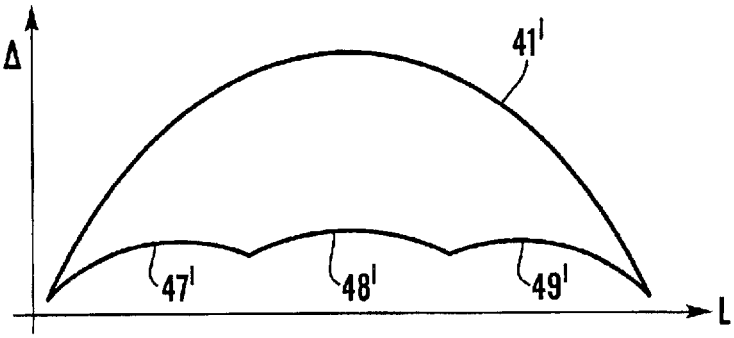
FIG. 13 is a graph corresponding to FIG. 11 but relating to the arrangement of FIG. 12.

FIG. 12 schematically represents a solution to this problem in that component 41 is split up into separate sub-components 47, 48, 49. As shown by the graph of FIG. 13, the deflection Δ and the effects of the deformation are considerably less for the arrangement of FIG. 12 (see curve $47^1$, $48^1$, $49^1$) than for the monolithic arrangement of FIG. 10 (see curve $41^1$). Thus the flexible limbs 36 for the arrangement of FIG. 12 are more easily produced since there is less deflection for which compensation is required.

Figure 14:
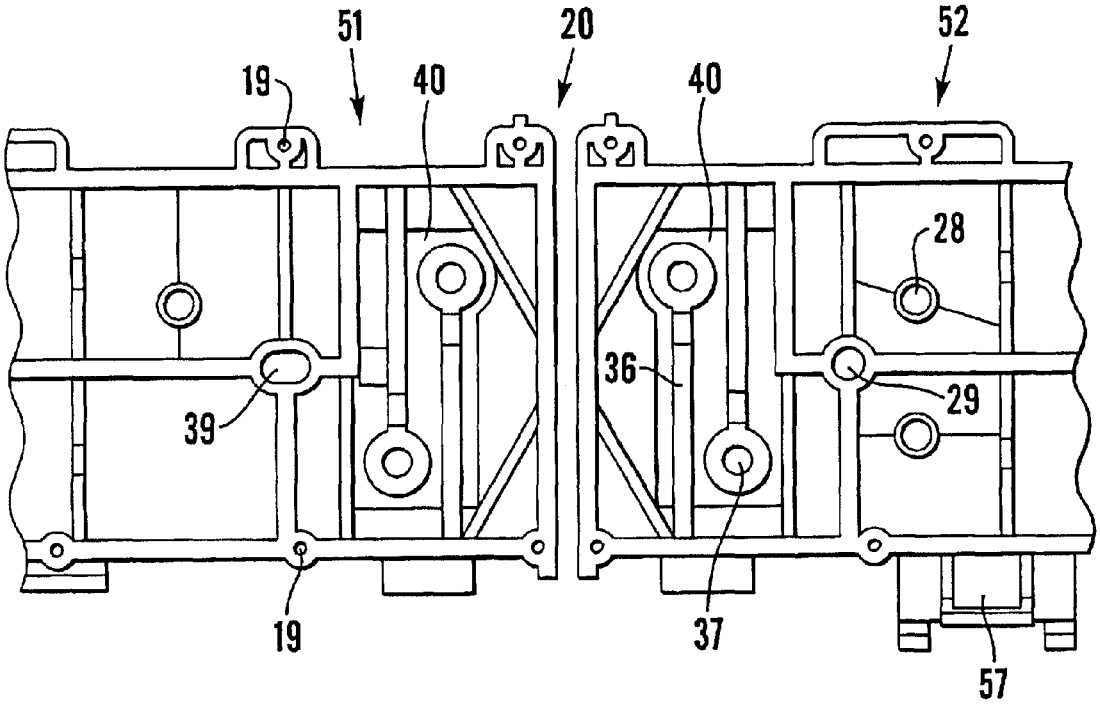
FIG. 14 is a top view of a further embodiment of the invention.

FIG. 14 illustrates the application of this solution to the vacuum guide member 20 which, instead of comprising a single member extending across the entire length of the printer, comprises a plurality, e.g. 3, of adjacent sub-components of which two, 51 and 52, are shown. Each sub-component forms its own sealed part of the vacuum circuit for the printer platen which extends across the tops of all the sub-components. The relative expansion of the arrangement of FIG. 14 is less because the free expansion is represented by:

$$\frac{L - Lo}{Lo} = C \times (Tc - Ta)$$

where Lo is the initial length L is the final, expanded length, and

L is the final, expanded length, and

C is the coefficient of thermal expansion.

The reduction in expansion leads to a reduction in the associated stresses to counteract it, and the overall deformation is also reduced.

Thus arrangements in accordance with FIGS. 12 and 14 have the advantage of permitting the use of wide ranges of combinations of materials.

By dividing member 20 into sub-components 51, 52 and also using flexible limbs 36 to mount the sub-components, as shown in FIG. 14, a particularly advantageous arrangement is obtained.

In modifications, the member 20 can comprise two, four or more aligned sub-components. The components 41, 42 may be any parts of a printer or any other device.

The arrangements described so far relate to elongate members, extending along a main axis. Where the overlying members have signified extents in two perpendicular dimensions, i.e. have a large overlapping area, the member 20 may be sub-divided in both dimensions to form a two-dimensional array of sub-components.

What is claimed is:

1. A printer device comprising a plurality of vacuum guides that are disposed along a length of a printer chassis and adjoined to said printer chassis, said printer chassis and said vacuum guides having different thermal coefficients of expansion, each of said vacuum guides being attached to said printer chassis by first attachment means at a first position and by second attachment means at a second position, spaced from said first position along said length, said vacuum guides and said printer chassis being relatively fixed at said first positions, wherein said vacuum guides are formed so that, at said second positions thereof, said vacuum guides can move relative to said printer chassis in a direction of said length, independently from a contact force (Fz) between said vacuum guides and said printer chassis at said second positions, wherein each of said vacuum guides comprises one or more flexible limb elements having respective free ends having means for attachment to said printer chassis.

2. A device comprising at least a first component and a second component adjoining each other over a length and having different thermal coefficients of expansion, said first and second components being attached to each other by first attachment means at a first position and by second attachment means at a second position, spaced from said first position along said length, said first and second components being relatively fixed at said first position, wherein at least said first component is formed so that, at said second position, said first component can move relative to said second component in a direction of said length, independently from a contact force (Fz) between said components at said second position, wherein said first component comprises one or more flexible limb elements having respective free ends having means for attachment to said second component.

3. A device according to claim 2, wherein said first component comprises a plurality of walls defining an enclosure and said flexible limb elements extend from said walls into the interior of said enclosure.

4. A device according to claim 3, wherein said flexible limb elements comprise a first limb element and a second limb element, and said plurality of wall comprise a first wall and a second wall opposed to said first wall, wherein said first limb element extends inwardly from said first wall and said second limb element extends inwardly from said second wall.

5. A device according to claim 2 comprising two second positions, one at each end of said first component, with said first position being arranged at a central location.

6. A device according to claim 2, wherein said first component is divided into a plurality of separate sub-components along a length thereof.

7. A device according to claim 2, wherein one or both of said components are capable of bowing in a direction perpendicular to adjoining surfaces of said components and the total amount of bow is equal to or less than 0.02% of said adjoining length.

8. A device according to claim 7, wherein the total amount of bow is equal to or less than 0.02% over a range of operating temperatures of said device.

9. A device according to claim 2 wherein said first component is made of plastics material and said second component is made of metal.

10. A device according to claim 9, wherein said first component is a vacuum guide member of a printer and said second component is a chassis of said printer.

11. A device comprising first and second components adjoining each other over a length and having different thermal coefficients of expansion, the components being attached to each other at a first position and at a second position, spaced from said first position along said length, wherein said first and second attachment positions are relatively displaceable in a direction of said length, independently from a contact force (Fz) between said components at said second position, wherein said first component comprises one or more flexible limb elements having respective free ends attachable to said second component.

* * * * *